United States Patent [19]

Rosenthal et al.

[11] Patent Number: 4,601,390

[45] Date of Patent: Jul. 22, 1986

[54] COLLAPSIBLE HAND CARRIER FOR BOTTLES

[76] Inventors: Roberta Rosenthal, 6 E. 30th St., New York, N.Y. 10016; Hilaire H. Dubourcq, 110 Christopher St., New York, N.Y. 10014

[21] Appl. No.: 695,385

[22] Filed: Jan. 28, 1985

[51] Int. Cl.[4] ..... B65D 75/00

[52] U.S. Cl. ..... 206/175; 206/193; 206/199; 206/427; 229/28 BC; 229/52 BC

[58] Field of Search ..... 206/427, 216, 175, 193, 206/199; 229/28 BC, 52 BC

[56] References Cited

U.S. PATENT DOCUMENTS

| | | | |
|---|---|---|---|
| 1,983,010 | 12/1934 | Spees | 206/427 |
| 2,680,556 | 6/1954 | Currie | 206/427 |
| 2,893,593 | 1/1959 | Toensmeier | 229/28 BC |
| 4,096,985 | 6/1978 | Wood | 206/427 |
| 4,184,595 | 1/1980 | Wackerman | 206/427 |
| 4,509,640 | 4/1985 | Joyce | 229/28 BC |

FOREIGN PATENT DOCUMENTS

| | | | |
|---|---|---|---|
| 503500 | 6/1951 | Belgium | 229/28 BC |
| 560830 | 4/1944 | United Kingdom | 229/28 BC |
| 2100231 | 6/1981 | United Kingdom | 206/427 |

*Primary Examiner*—Joseph Man-Fu Moy

*Attorney, Agent, or Firm*—Michael Ebert

[57] ABSTRACT

A collapsible hand carrier for bottles of standard size. When fully erected, the carrier has a box-like form and an internal array of cells to accommodate the bottles. The structure of the carrier is formed of flexible panel material and is defined by a pair of side panels provided with complementary handle extensions, a pair of end panels hingedly joined to the end edges of the side panels, and a bottom panel hingedly joined to the bottom edges of the side panels and disconnected from the end panels. The end and bottom panels each include a center fold to create a gusset whereby the carrier may readily be collapsed into the flat state for storage or shipment, or expanded into the erected state for use as a carrier. Cut into each corner of the carrier formed at the junctions of the side and end panels is a pair of parallel slots. These are spaced from the top and bottom edges of the panels and extend horizontally from the center fold on the related end panel and a vertical fold line on the related side panel to create a snap-in corner section. When pressed in at its corner junction, the section reverses itself to set up within the carrier interior a cell adapted to accommodate a single bottle. The central region between the four corner cells functions as a compartment to receive an additional bottle or other items.

10 Claims, 15 Drawing Figures

COLLAPSIBLE HAND CARRIER FOR BOTTLES

BACKGROUND OF INVENTION

1. Field of Invention

This invention relates generally to hand carriers for bottles and other items, and more particularly to a collapsible hand carrier adapted to protectively accommodate a group of bottles of standard size, the carrier also being convertible into an all-purpose tote or shopping bag.

2. State of the Art

The conventional shopping or tote bag is provided with handles and is formed of kraft paper, plastic film or fabric material of sufficient strength to support the load for which it is intended without rupturing the bag material.

Thus should a consumer purchase in a supermarket or other retail establishment an assortment of items including canned goods, bottled beverages and groceries, these can all be stuffed into the shopping bag. In the case of liquid-filled bottles made of glass, these give rise to a problem; for should the bottles in the bag be jostled, they may crack. And if a cracked bottle contains carbonated beverage such as beer or a soft drink, the resultant abrupt release of internal pressure may result in an explosion with possibly serious consequences.

In order to protectively package beer bottles of pint size, it is now the practice to provide a so-called six-pack. In this pack, half a dozen bottles are individually housed in the cells of a multi-cellular cardboard carrier having a handle, the cells maintaining a separation between the bottles to avoid jostling. But should a consumer desire to purchase an assortment of bottled beverages in standard quart or liter sizes, these are normally not pre-packaged and therefore remain unprotected when placed in a conventional shopping bag.

Thus, if one buys, say, two bottles of club soda, a bottle of tonic water and three bottles of ginger ale, all having the same standard size, the usual shopping or tote bag is ill-suited for this heavy load, particularly if it is of kraft paper construction. Hence if an empty carton is available in the supermarket, the purchaser may use this as an improvised carrier for his bottles, even though the carton lacks handles and is difficult to carry. From the marketing standpoint, any item which is difficult to carry home is less likely to be sold than one which presents no handling problem.

Moreover, the consumer is not only faced with the problem of carrying a load of full bottles from the supermarket to his home or elsewhere, for in recent years he also is confronted with the problem of returning empty bottles. Many states have introduced, by statute, bottle deposit requirements, and the consumer, in order to recover his 5-cent deposit per bottle or whatever other amount is imposed, must return the empty bottles to the store. The stated economic and environmental purpose underlying this statutory requirement is to encourage consumers to return empty bottles for recycling and to avoid litter resulting from discarded bottles. This makes it necessary for the consumer to make use of a carrier or bag of some sort to perform the return function. The conventional shopping or tote bag is no better suited for this purpose than for carrying full bottles.

The prior art discloses various forms of hand carriers specifically designed for bottles. Thus the Gilbert Pat. No. 4,250,992 shows a bottle carrier fabricated from corrugated board to form a tray having a center handle which divides the tray into two compartments, each loosely holding three bottles. This tray is not collapsible, nor does it protect loose bottles in each compartment from jostling against each other.

The Lipton Pat. No. 2,351,528 discloses a bottle carrier having bendable flaps to define bottle compartments. But the flaps are unsupported and the carrier is not collapsible. The Wood et al. Pat. No. 4,089,457 and the Thurmer Pat. No. 1,983,418 each provide an insert for cartons which acts to divide the carton into bottle-holding cells. Also of background interest are the Pergande et al. Pat. No. 4,397,393 and the British Pat. Nos. 683,205 (1949) and 560,830 (1944), though none of the references discloses collapsible carriers.

SUMMARY OF INVENTION

In view of the foregoing, the main object of this invention is to provide a hand carrier for bottles which is repeatedly useable both for carrying full bottles of standard size from a store to the home as well as for returning empty bottles to the store, the carrier being collapsible into a flat state when not in use so that it occupies little storage space.

A significant feature of the invention is that the hand carrier, when fully erected and activated, is then provided with an array of corner cells each adapted to protectively accommodate a single bottle. The cells are formed by snap-in corner sections so that the user, depending on bottle load requirements, can snap in less than the full array of cells and use the remaining space for other purchased items. Or the consumer may elect not to snap in any of the cells and to use the carrier in this condition as an all-purpose tote or shopping bag.

More particularly, an object of the invention is to provide a versatile hand carrier of the above type formed entirely of flexible panel material such as single ply corrugated board having plastic facing films which the carrier, though light weight, is of exceptionally high structural strength and is capable of carrying relatively heavy loads constituted by several large size beverage bottles.

Also an object of this invention is to provide a carrier of the above type which is fabricated from a single blank of high strength panel material.

Still another object of the invention is to provide a collapsible carrier of the above type which may be mass-produced at relatively low cost.

These and other objects are accomplished in a collapsible hand carrier for bottles of standard size. When fully erected, the carrier has a box-like form and an internal array of cells to accommodate the bottles. The structure of the carrier is formed of flexible panel material and is defined by a pair of side panels provided with complementary handle extensions, a pair of end panels hingedly joined to the end edges of the side panels, and a bottom panel hingedly joined to the bottom edges of the side panels and disconnected from the end panels. The end and bottom panels each include a center fold to create a gusset whereby the carrier may readily be collapsed into the flat state for storage or shipment, or expanded into the erected state for use as a carrier. Cut into each corner of the carrier formed at the junctions of the side and end panels is a pair of parallel slots. These are spaced from the top and bottom edges of the panels and extend horizontally from the center fold on the related end panel and a vertical fold line on the related side panel to create a snap-in corner section. When pressed in at its corner junction, the section reverses itself to set up within the carrier interior a cell adapted to accommodate a single bottle. The central region between the four corner cells functions as a compartment to receive an additional bottle or other items.

OUTLINE OF DRAWINGS

For a better understanding of the invention as well as other objects and further features thereof, reference is made to the following detailed description to be read in conjunction with the accompanying drawings, wherein.

DETAILED DESCRIPTION OF INVENTION

First Embodiment

Figure 2:
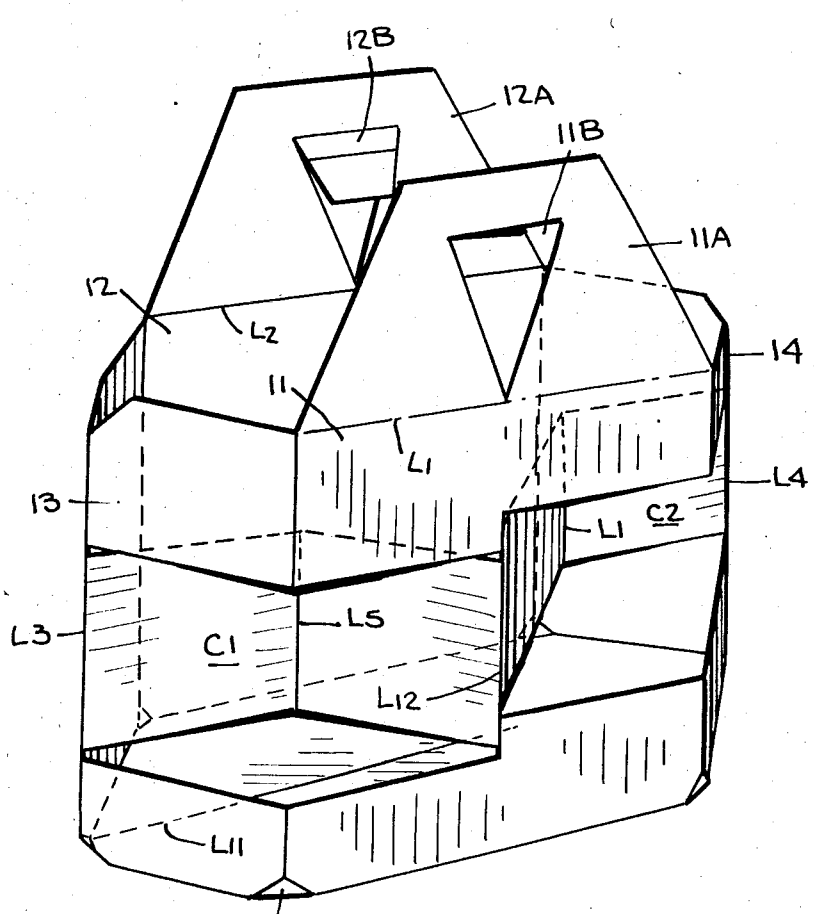
FIG. 2 is the same as FIG. 1, but with the corner sections in their active mode.
Figure 1:
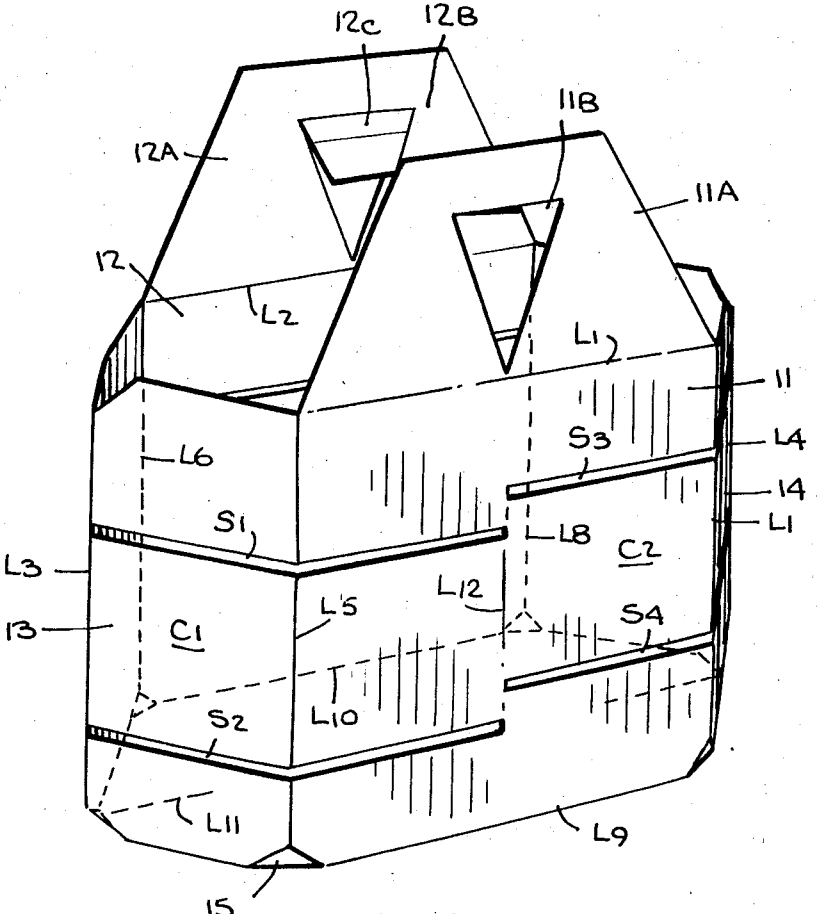
FIG. 1 is a perspective view, in the unloaded condition, of one preferred embodiment of a collapsible hand carrier for bottles in accordance with the invention, the carrier being shown with its snap-in corner sections in their inactive mode.
Figure 3:
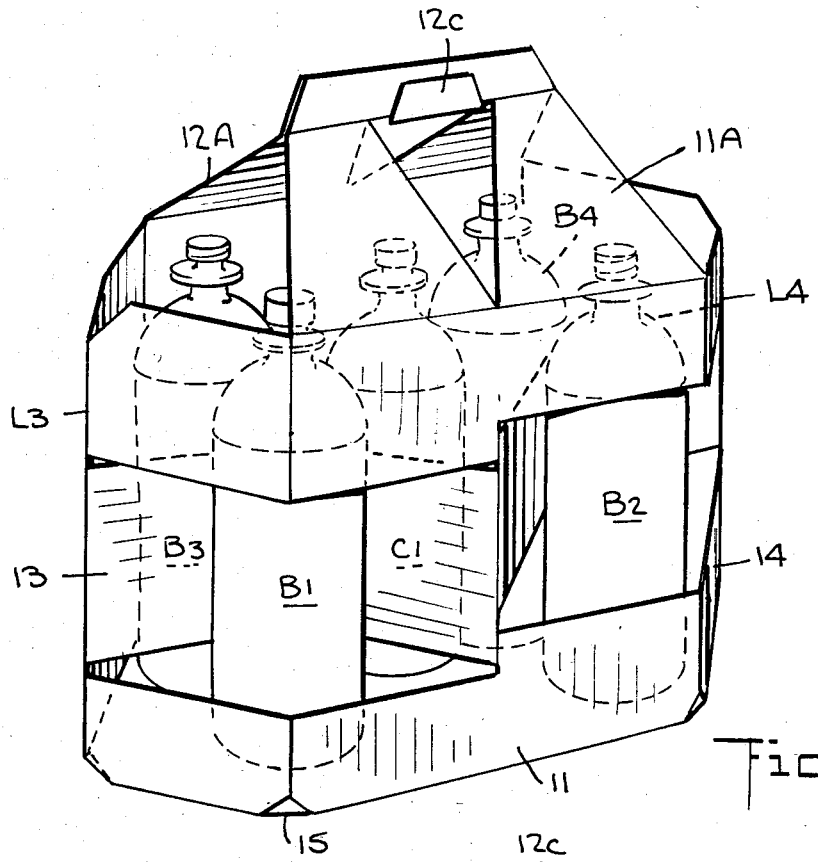
FIG. 3 illustrates the carrier with the corner sections in the active mode to define cells which are occupied by bottles.

Referring now to FIGS. 1, 2 and 3, there is illustrated in these figures a collapsible hand carrier for bottles which has a box-like configuration whose cross section in the horizontal plane has the geometry of a stretched octagon having six faces.

Figure 4:
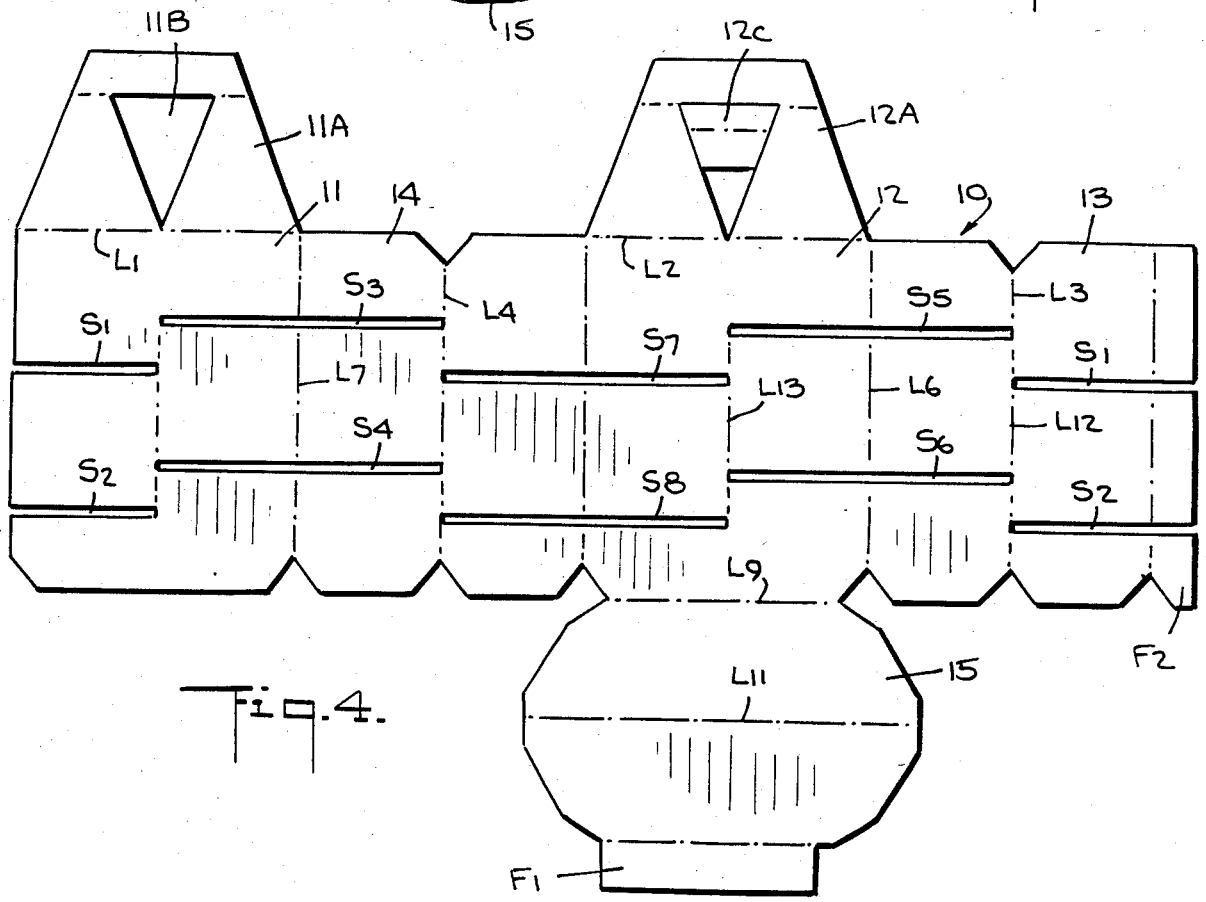
FIG. 4 is a plan view of the single blank from which the carrier illustrated in FIG. 1 is formed.

As shown in FIG. 4, the structure is fabricated from a single blank 10 of flexible panel material. In practice this blank may be made of solid or foam plastic construction such as PVC, polyethylene or any other suitable plastic having planar faces to facilitate printing and graphics. A preferred panel material is a single ply corrugated board having plastic film faces laminated to the fluted core. But regardless of the material used, it must be capable, when scored, of creating living hinges at the score lines so that the structure may be collapsed or erected as desired. The blank 10 is die cut, scored and slotted to create the form shown in FIG. 4.

The carrier structure is defined by generally rectangular front and rear side panels 11 and 12, left and right end panels 13 and 14, and a bottom panel 15. The side panels 11 and 12 are provided above horizontal fold lines $L_1$ and $L_2$ with trapezoidal extensions 11A and 12A. These extensions have triangular openings 11B and 12B therein to form complementary handles. Thus the extensions are foldable toward each other to permit the user to extend the fingers of one hand through the openings to grasp the handles. A foldable flap 12C is provided on extension 12A to hold the handles together.

The left and right end panels 13 and 14 each have a longitudinal center fold therein ($L_3$ and $L_4$) to form gusset leaves. The left end panel 13 is hingedly joined to the respective left end edges of side panels 11 and 12 by fold lines $L_5$ and $L_6$, while the right end panel 14 is likewise joined to side panels 11 and 12 by fold lines $L_7$ and $L_8$.

Bottom panel 15 is formed into a gusset by a longitudinal center fold line $L_{11}$. The width of bottom panel 15 which is hingedly joined to the bottom edges of side panels 11 and 12 by fold lines 9 and 10, is greater than the width of end panels 13 and 14; hence in the erected state, the end panels belly out to form a triangular bay, thereby creating a stretched octagonal form, four faces of which are defined by the angled end panels, and remaining two faces, which are wider, by the side panels.

Bottom panel 15 is joined only to side panels 11 and 12 and is disconnected from end panels 13 and 14 to permit a gusset action. This makes it possible to collapse the carrier by pressing side panels 11 and 12 together and in doing so, causing the bottom panel and the end panel gussets to fold out so that the entire carrier structure is then in a compact flat state to facilitate storage of the carrier. To erect the carrier, the side panels are pulled apart to cause the gussetted end panels and bottom panel to expand.

Cut into the left front corner formed at the junction of left end panel 13 and front side panel 11 is a pair of parallel slots $S_1$ and $S_2$ which are spaced from the top and bottom edges of these panels. Slots $S_1$ and $S_2$ extend horizontally from center fold $L_3$ on end panel 13 to a vertical score line $L_{12}$ at the midpoint of front panel 11 which forms a fold, thereby creating a first snap-in corner section C1.

Because of the flexibility of the panel material, the user, by pressing in corner section C1 at its junction $L_5$, causes it to snap into reverse. As a consequence, as shown in FIG. 2, the angled walls of the corner section then lie within the corner section to set up a cell therein for receiving a bottle B1 as shown in FIG. 3.

Cut into the right front corner formed at the junction of right end panel 14 and front side panel 11 is a pair of parallel slots $S_3$ and $S_4$ which have the same spacing therebetween as slots $S_1$ and $S_2$, but are upwardly displaced therefrom. Slots $S_3$ and $S_4$ extend horizontally from center fold $L_4$ on end panel 14 to the vertical score line $L_{12}$, thereby creating a second snap-in corner section C2 which when pushed in sets up a second cell for receiving a bottle B2.

Cut into the left rear corner formed at the junction of left end panel 13 and rear side panel 12 is a pair of parallel slots $S_5$ and $S_6$ whose positions correspond to those of slots $S_3$ and $S_4$ and extending to a vertical score line $L_{13}$ to create a snap-in corner section C3 which when pushed in, reverses itself to set up a third cell C3 for accommodating a bottle B3. And cut into the right rear corner formed at the junction of right end panel 14 and rear side panel 12 is a pair of parallel slots $S_7$ and $S_8$ at positions corresponding to those of slots $S_1$ and $S_2$ and extending to vertical score line $L_{13}$ to create a snap-in corner section C4 which when snapped in forms a fourth cell C4 for accommodating bottle B4.

As shown in FIG. 4, the blank 10 from which the carrier is formed is die cut to include a flap $F_1$ extending from bottom panel 15 and a flap $F_2$ extending from end panel 13. These flaps, when the carrier is erected, are glued or otherwise attached to the adjacent panels to hold the structure together. In practice, in lieu of flap attachments, tape may be used for this purpose.

Figure 5:
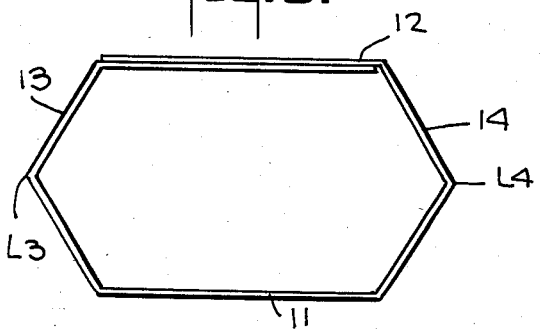
FIG. 5 shows the interior of the carrier with all of the snap-in corner cells inactive.
Figure 11:
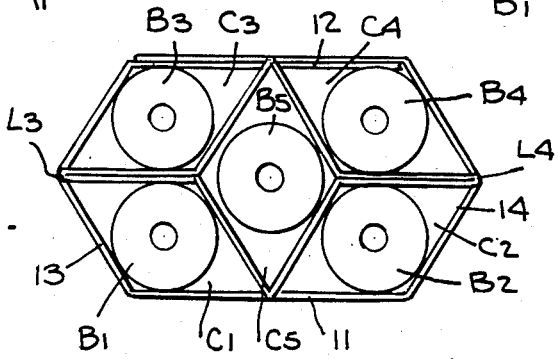
FIG. 11 shows the interior with all corner cells active as well as the resultant central compartment.

In the erected state, when none of the cells is activated, the geometry of the carrier is that shown in FIG. 5 where it will be seen that the interior is undivided and the handled carrier can then serve as a tote bag or shopping bag. In the erected state when all of the cells are activated, as shown in FIG. 11, one then not only has four corner cells C1 to C4, but also a compartment C5 in the diamond-shaped region intermediate the cells. This may be used to accommodate a fifth bottle B5 or as space for other items.

Figure 6:
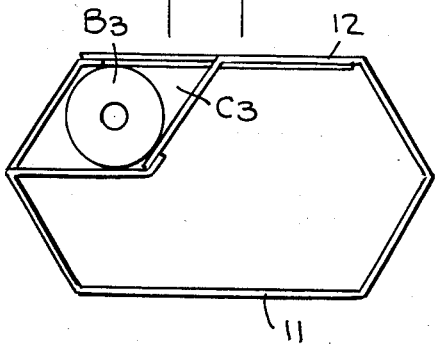
FIG. 6 shows the interior with but one corner cell active.
Figure 7:
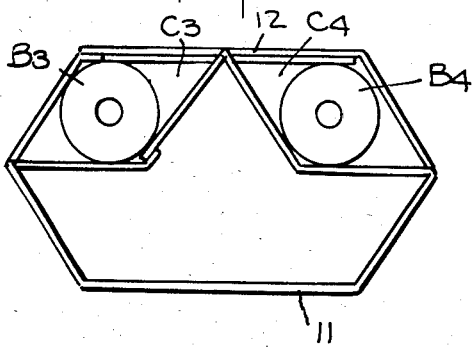
FIG. 7 shows the interior with two rear corner cells active.
Figure 8:
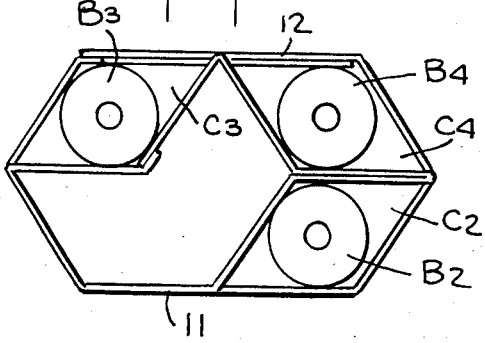
FIG. 8 shows the interior with two rear corner cells and one front corner cell active.

Because each of the snap-in sections may be separately activated, the carrier can be set up to meet varying load requirements. Thus if the user has only one bottle to carry among other things, he can then activate only cell C3 as shown in FIG. 6 and use the remaining interior space, which is substantial, for an assortment of other purchased items. But if two bottles have to be carried, as shown in FIG. 7, the user may activate cells C3 and C4 for this purpose, the remaining space being used for other goods. FIG. 8 shows cells C3, C4, and C2 activated to accommodate three bottles.

Figure 9:
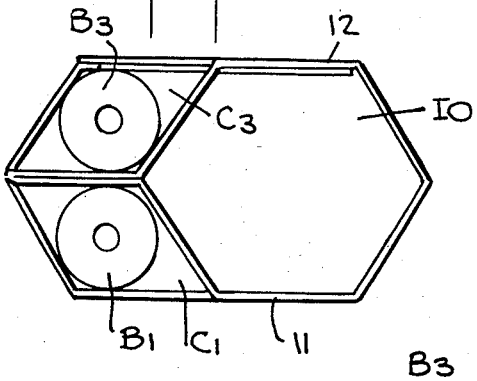
FIG. 9 shows the interior with one rear corner cell and a correspondingly positioned front corner cell active.
Figure 10:
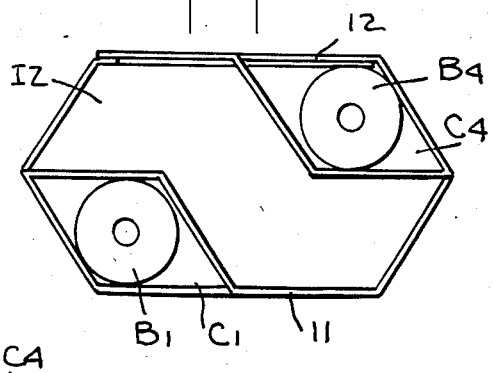
FIG. 10 shows the interior with one rear corner cell and an oppositely-positioned front corner cell active.

As will be evident from FIGS. 9 and 10, one can selectively activate the cells so as to create a free interior space whose configuration depends on which cells are activated, and in doing so shape the interior space to accommodate a particular form of load. Thus in FIG. 9, cells C1 and C3 are activated to create an octagonal interior space IO, while in FIG. 10, cells C1 and C4 are activated to create a Z-shaped space IZ. Such permutations permit the user, faced with carrying a particular load constituted by bottles or other items, to snap in those cells which may provide a reasonably good load distribution so that the center of gravity for the load is roughly in line with the handles for ease of handling.

Second Embodiment

Figure 13:
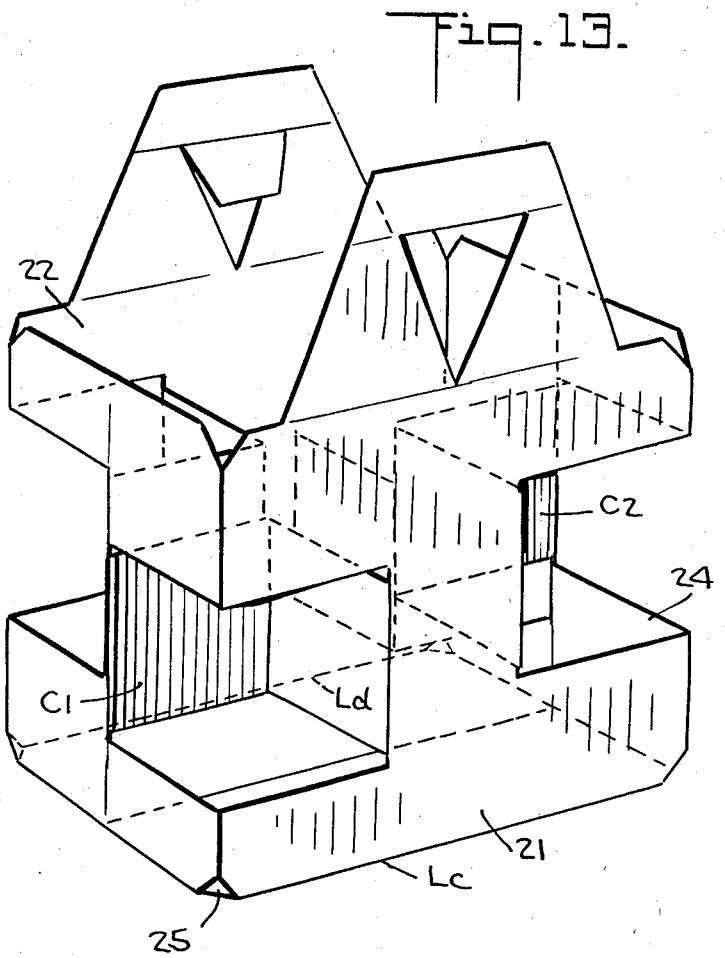
FIG. 13 shows the FIG. 12 carrier with the corner sections in their active mode.
Figure 12:
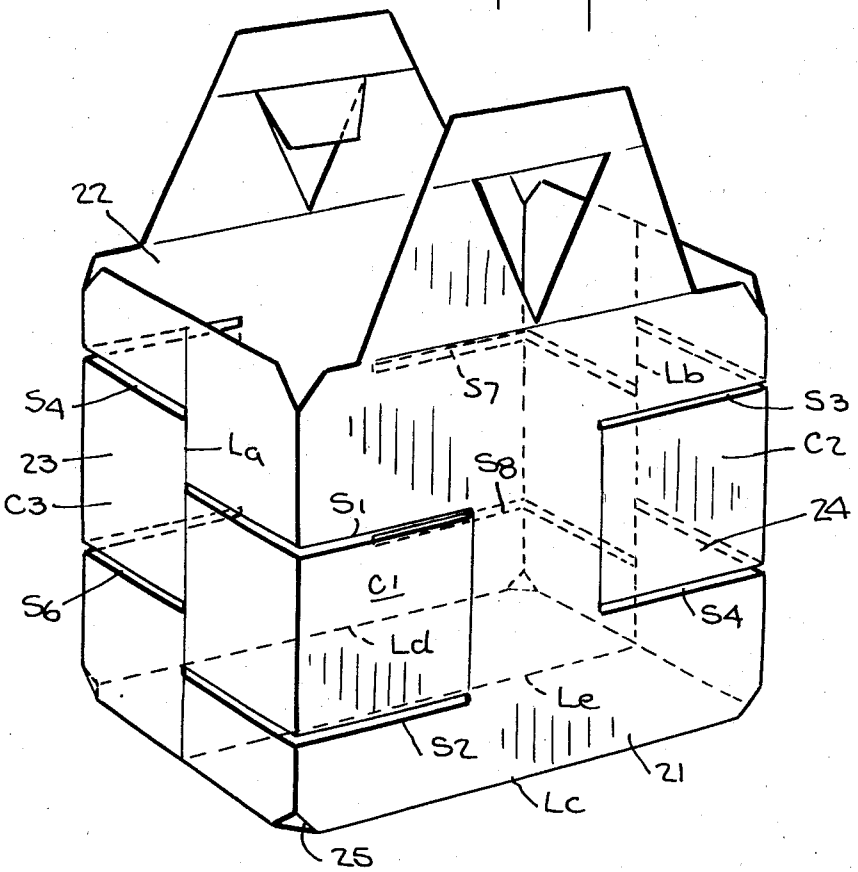
FIG. 12 shows another embodiment of the carrier in a rectangular configuration with the snap-in corner sections in their inactive mode.
Figure 14:
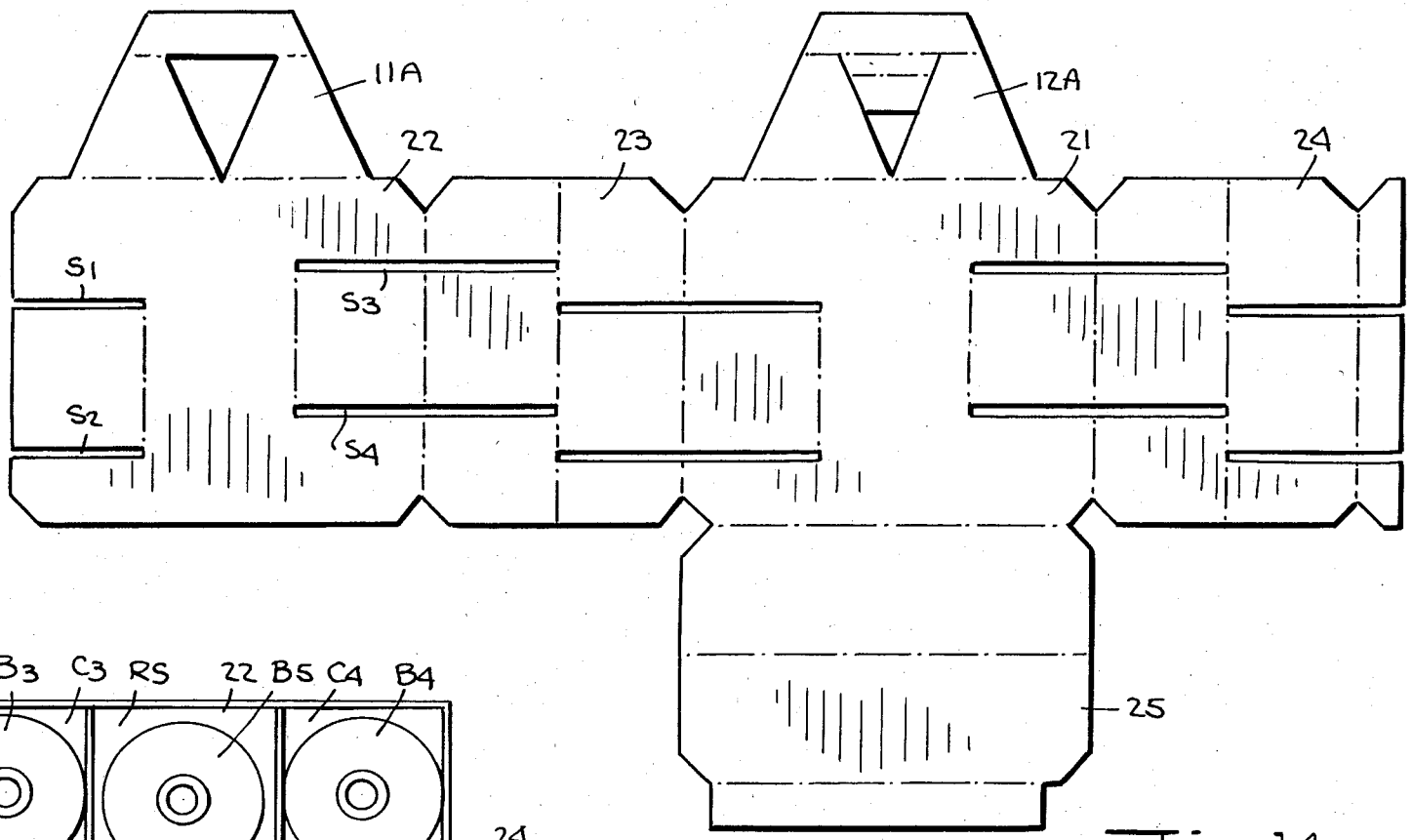
FIG. 14 shows the single blank from which the FIG. 12 carrier is fabricated.

In the box-like carrier shown in FIGS. 12 and 13, the cross-sectional geometry of the carrier is rectangular. In this instance the carrier is also formed from a single blank 20 of flexible panel material as shown in FIG. 14, which material may be the same used in forming blank 10 in the previous embodiment. The carrier is constituted by a front side panel 21, a rear side panel 22, left and right end panels 23 and 24 and a bottom panel 25.

In this instance the width of the bottom panel 25 matches that of the end panels 23 and 24 so that the end panels which are produced with center folds $L_a$ and $L_b$ forming gussets, do not triangulate when the carrier is erected. The bottom panel 25 is hingedly joined to the bottom edges of the side panels 21 and 22 by fold lines $L_c$ and $L_d$, and is disconnected from the end panels, the bottom panel having a center fold to provide a gusset action, making it possible as in the first embodiment to collapse the carrier into the flat state.

Figure 15:
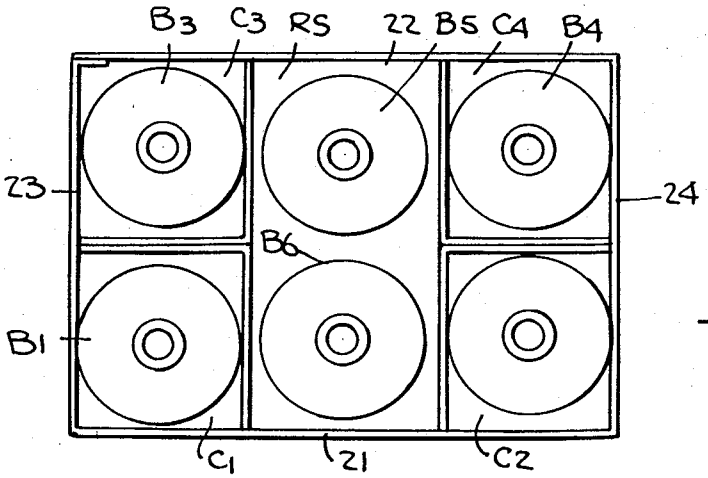
FIG. 15 shows the interior of the FIG. 12 carrier in its fully loaded condition.

The carrier is provided as in the first embodiment with an array of slots $S_1$ to $S_8$ to create snap-in corner sections C1 to C4 which when activated, reverse themselves to set up four cells for accommodating bottles B1 to B4 as shown in FIG. 15. The central space between the cells forms a rectangular compartment RC for accommodating two additional bottles B5 and B6 or other items.

Thus the carrier in this embodiment is essentially the same in structure and function as the first embodiment carrier, but has a more traditional shape and a somewhat smaller interior space. The longevity of the carrier depends on the material used, and when this material is a high-quality plastic, the carrier will have a prolonged working life.

While there has been shown and described preferred embodiments of COLLAPSIBLE HAND CARRIER FOR BOTTLES in accordance with the invention, it will be appreciated that many changes and modifications may be made therein without, however, departing from the essential spirit thereof. Thus, while the carrier has been described in dimensions which accommodate standard large size bottles, it may in practice be dimensioned to receive small bottles of the type presently packaged in six-packs, for while a six-pack package is disrupted when the bottles are removed therefrom, the carrier in accordance with the invention is repeatedly useable for carrying empty as well as full bottles, and is not therefore a one-shot package. And instead of placing a single large bottle in each cell, one can put therein a stack of small cans.

Also, instead of a blank, as shown in FIG. 4, provided with flaps which must be glued or otherwise joined to the adjacent panels when the carrier is erected to maintain the structure in its carrier form, one may use wing tabs for this purpose which fit into locking slots and require no glue to hold. In this way, one can stack a supply of blanks in the flat state in a store, and later convert a blank into a carrier when there is a request for a bottle carrier.

We claim:

1. A repeatably usable collapsible hand carrier for bottles of standard size, the carrier being fabricated of flexible panel material and having a structure comprising:

A. front and rear side panels provided with complementary handle extensions;

B. left and right end panels hingedly joined to the end edges of the side panels;

C. a bottom panel hingedly joined to the bottom edges of the side panels and disconnected from the end panels, the bottom panel and the end panels all having a center fold to create a gusset whereby the carrier may be collapsed after use into a flat state by pressing the side panels together, and in doing so, causing the bottom panel and the end panel gussets to fold out, and the carrier may be erected for reuse by pulling the side panels apart; and D. four snap-in corner sections formed at the junctions of the side and end panels, each section being defined by a pair of parallel slots spaced from the top and bottom edges of the panels and extending horizontally from the center fold of the related end panel and a vertical fold line on the related side panel, whereby when the hand carrier is erected and a corner section is pressed in at its junction, the section then reverses itself to set up within the interior of the carrier a corner cell adapted to accommodate a single standard bottle.

2. A hand carrier as set forth in claim 1 wherein said carrier is formed from a single blank of panel material which is die cut to define the panels and the slots therein, the hinges which join the panels and the center fold being defined by score lines in the blank.

3. A hand carrier as set forth in claim 1 wherein said front and rear side panels are provided with complementary hand extensions.

4. A hand carrier as set forth in claim 3 wherein said handle extensions are formed by trapezoidal extensions from the side panels each having an opening therein to accommodate the fingers of a hand.

5. A hand carrier as set forth in claim 1 wherein the pair of parallel slots which define the front left corner section of the carrier is at a different level than the pair of slots which define the front right corner section, the pair of slots which define the rear left corner section being at a level corresponding to the level of the pair which defines the front right corner section, the pair of slots which define the rear right corner section being at a level corresponding to the level of the pair which defines the front left corner section.

6. A carrier as set forth in claim 1 wherein said bottom panel has a width which is smaller than the width of the end panel, whereby when the carrier is erected, the end panels create a triangular bay and the carrier then has a stretched octagonal form.

7. A carrier as set forth in claim 1 wherein the width of the bottom panel matches the width of the end panels, whereby when the carrier is erected, it then has a rectangular form.

8. A carrier as set forth in claim 1 wherein said panel material is formed of a single ply corrugated board having plastic film faces.

9. A carrier as set forth in claim 1 whose dimensions are such as to accommodate quart size bottles.

10. A carrier as set forth in claim 1 in which the material of the structure is a solid plastic and the hinges thereof are living hinges created by score lines in the panel material.

* * * * *